US011209210B2

(12) United States Patent
Yoskowitz

(10) Patent No.: US 11,209,210 B2
(45) Date of Patent: Dec. 28, 2021

(54) BEVERAGE CONTAINERS AND COOLANTS THEREFORE

(71) Applicant: David Yoskowitz, Woodcliff Lake, NJ (US)

(72) Inventor: David Yoskowitz, Woodcliff Lake, NJ (US)

( * ) Notice: Subject to any disclaimer, the term of this patent is extended or adjusted under 35 U.S.C. 154(b) by 129 days.

(21) Appl. No.: 16/488,644

(22) PCT Filed: Mar. 12, 2018

(86) PCT No.: PCT/US2018/021992
§ 371 (c)(1),
(2) Date: Aug. 26, 2019

(87) PCT Pub. No.: WO2018/169859
PCT Pub. Date: Sep. 20, 2018

(65) Prior Publication Data

US 2020/0025442 A1 Jan. 23, 2020

Related U.S. Application Data

(60) Provisional application No. 62/470,469, filed on Mar. 13, 2017, provisional application No. 62/525,867, filed on Jun. 28, 2017.

(51) Int. Cl.
*F25D 3/08* (2006.01)
*F25D 31/00* (2006.01)

(52) U.S. Cl.
CPC ..... *F25D 31/007* (2013.01); *F25D 3/08* (2013.01); *F25D 2303/0831* (2013.01);
(Continued)

(58) Field of Classification Search
CPC ... F25D 2303/08223; F25D 2303/0831; F25D 2331/803; F25D 2331/81; F25D 2400/36; F25D 2700/12; F25D 31/007; F25D 3/08
See application file for complete search history.

(56) References Cited

U.S. PATENT DOCUMENTS 4,660,132 A * 4/1987 Basler ..... F21V 29/004 165/104.33
4,735,063 A * 4/1988 Brown ..... F25D 3/107 62/293

(Continued)

FOREIGN PATENT DOCUMENTS

DE 29908927 U1 10/1999
GB 2250576 A 6/1992

(Continued)

OTHER PUBLICATIONS

International Search Report for corresponding PCT Application No. PCT/US2018/021992 dated Jun. 1, 2018.

(Continued)

*Primary Examiner* — Filip Zec
(74) *Attorney, Agent, or Firm* — Abelman, Frayne & Schwab; Stefan Knirr

(57) ABSTRACT

The device includes a container (10) having a top (12) and a bottom (14). A receptacle (15) is formed in the container and joined to an orifice (22) at the bottom (14). A cooling medium (26) is contained within the receptacle and able to retain a cooling environment to cool the beverage. In one embodiment, a beverage container has an opening (72) that permits the emptying of the beverage from the container and a coolant capsule (73) within said container. The cooling capsule (73) contains a cooling medium and the capsule is dimensioned such that the capsule is larger than the opening (72) but has surface characteristics (77,78) which permit the beverage within the container to bypass the capsule (73) and to exit the opening.

3 Claims, 11 Drawing Sheets

(52) U.S. Cl.
CPC ..... *F25D 2303/08223* (2013.01); *F25D 2331/803* (2013.01); *F25D 2331/81* (2013.01); *F25D 2400/36* (2013.01); *F25D 2700/12* (2013.01)

(56) References Cited

U.S. PATENT DOCUMENTS 4,761,314 A * 8/1988 Marshall ..... F25D 3/08 428/11
4,889,302 A 12/1989 Tucker
5,044,173 A * 9/1991 Cheng ..... A47G 19/2288 62/372
5,189,892 A * 3/1993 Roberts ..... A47G 19/127 62/372
5,467,877 A * 11/1995 Smith ..... A61J 9/00 215/11.1
5,597,087 A * 1/1997 Vinarsky ..... A45F 3/16 215/396
5,609,039 A 3/1997 Green et al.
6,474,096 B1 * 11/2002 de la Guardia .... A47G 19/2288 62/457.3
6,758,058 B1 7/2004 Citrinell
7,770,410 B2 * 8/2010 Cote ..... F25D 31/006 62/457.4
8,079,411 B2 * 12/2011 Cerra ..... A47G 19/2288 165/185
9,402,409 B2 * 8/2016 Albano ..... A23G 9/083
2003/0079492 A1 5/2003 Pechous et al.
2008/0000259 A1 * 1/2008 Shewchuk ..... F25D 31/007 62/457.3
2008/0273319 A1 11/2008 Vanderschuit
2012/0031869 A1 * 2/2012 Bauer ..... B29C 49/0073 215/6

FOREIGN PATENT DOCUMENTS

WO 200907921 A1 7/2009
WO 2016002597 A1 1/2016

OTHER PUBLICATIONS

Written Opinion for corresponding PCT Application No. PCT/US2018/021992 dated Jun. 1, 2018.

* cited by examiner

FIG. 10
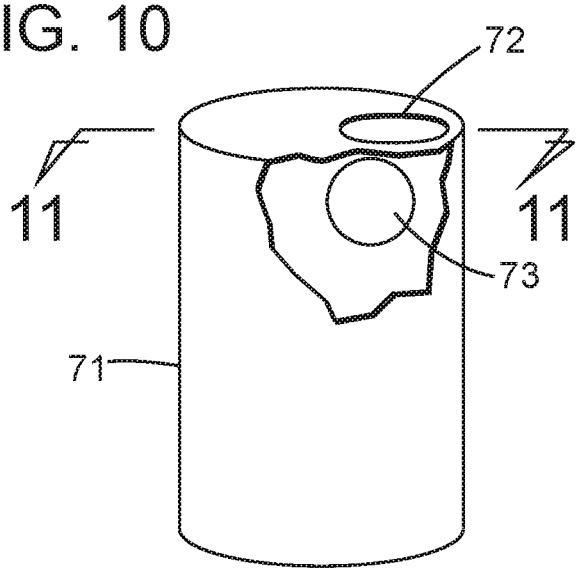
FIG. 11
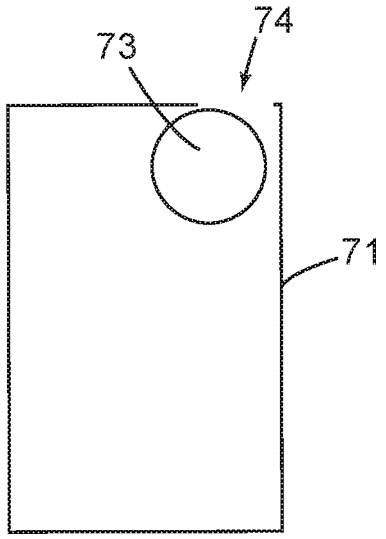
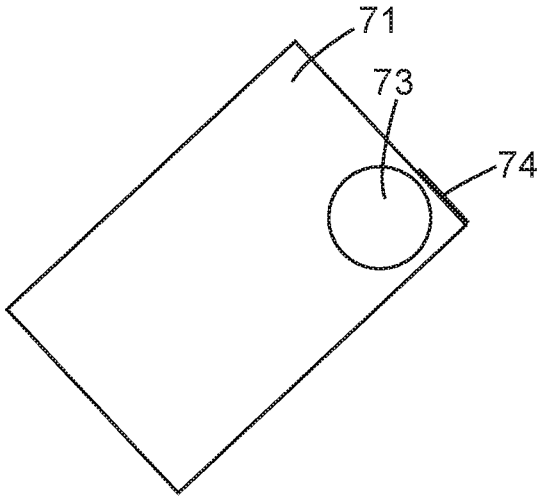
FIG. 12

BEVERAGE CONTAINERS AND COOLANTS THEREFORE

CROSS REFERENCE TO RELATED APPLICATIONS

This application is a national phase of PCT application No. PCT/US2018/021992, filed Mar. 12, 2018, which claims priority to U.S. provisional patent application No. 62/470,469, filed Mar. 13, 2017, and U.S. provisional patent application No. 62/525,867, filed Jun. 28, 2017, all of which are incorporated herein by reference hereto.

FIELD OF INVENTION

The present invention relates to articles of manufacture and methods by which beverage containers are provided with prolonged cooling cycles.

The present invention relates to beverage containers and coolants used in conjunction with the beverage containers in which at least one coolant, but preferably a coolant combination is provided which in the latter case is comprising of first a coolant that remains in liquid state below the freezing temperature of ice and above the freezing temperature of the beverage and a second coolant, preferably ice with the coolant maintaining a desirable temperature for ingestion of the beverage for a prolonged period.

BACKGROUND OF THE INVENTION

Many beverages are intended to be ingested when cold. Most common are beer, soda and juices, but also include almost any liquid drink.

Manufacturers have created packages that are designed to maintain the liquid in a cooled state for period of time. The most common containers are either glass or plastic bottles or aluminum cans. However, particularly where ingestion takes place over time and/or the drink is being served at a time after refrigeration (such as at sporting events), the desired temperature is often elevated to a less optimum degree before the beverage is completely consumed.

Glass and plastic containers, due to their greater insulation characteristic tend to maintain the beverage within them cooler for longer periods of time. However because of the better insulation characteristics of the plastic or glass, the beverages take longer to be cooled. Moreover, when held in the hand of a user, the insulating qualities of the glass or plastic may lead the consumer to believe that the beverage within the container is not as cold as the tactile sense perceived by the consumer.

Conversely, aluminum has significantly less insulating capabilities than glass and most of the plastics used for beverage containers. Thus, the beverage within the aluminum can cools more rapidly. Moreover, when held in the hand of a user, the aluminum can feels colder, not necessarily because the beverage is being maintained in its cold condition but because the heat of the user is being drawn off by the aluminum can, thus providing a perception of cold to the user.

Without regard to which type of beverage container keeps the beverage colder for a longer period of time, it is generally recognized that extending the period of time that the beverage remains at a colder temperature is desirable. As a result, there have been numerous attempts to provide supplemental devices to maintain the beverage at a lower temperature for longer periods of time. Many are cumbersome and often complex. In general, they are often supplemental devices, not readily incorporated into disposal containers or if adapted for integral use are relatively expensive and not environmentally suitable for one time use and disposal.

SUMMARY OF THE INVENTION

The present invention provides a solution to the deficiencies of prior devices and provides a beverage container which integrates a coolant which is of low cost, is environmentally friendly, and permits ready disposal.

In one embodiment, the invention provides a device for holding and cooling a beverage comprising: a container having a top and a bottom; a receptacle formed in the container and joined to an orifice at the bottom; and a cooling medium contained within the receptacle and able to retain a cooling environment to cool the beverage.

In another embodiment, the invention provides an encapsulated coolant which is able to assist in prolonging the cool temperature of a beverage in which the capsule is emplaced within the container, preferably during container manufacture, and subjected to being cooled with the beverage containing container. Either on the basis of configuration and/or dimension and/or by the provision of a series of flow channels, the capsule does not unacceptably restrict with the emptying of the beverage from the container.

These and other objects and advantages of the invention will become more apparent to those of ordinary skill upon consideration of the attached drawings and the following description of the preferred embodiments which are meant by way of example only, but are not to be construed as in any way limiting the invention claimed and disclosed herein.

It is to be understood that both of the foregoing and general description and the following detailed description are exemplary and are intended to provide explanation of the invention claim.

BRIEF DESCRIPTION OF THE DRAWINGS

FIG. 10 is a partially broken away perspective view of a beverage container of the present invention according to a $5^{th}$ embodiment.

FIG. 11 is a sectional view taken along lines 11-11 of FIG. 10.

FIG. 12 is a sectional view of FIG. 10 with the beverage can shown in a tilted position.

DETAILED DESCRIPTION OF THE INVENTION

Figure 1:
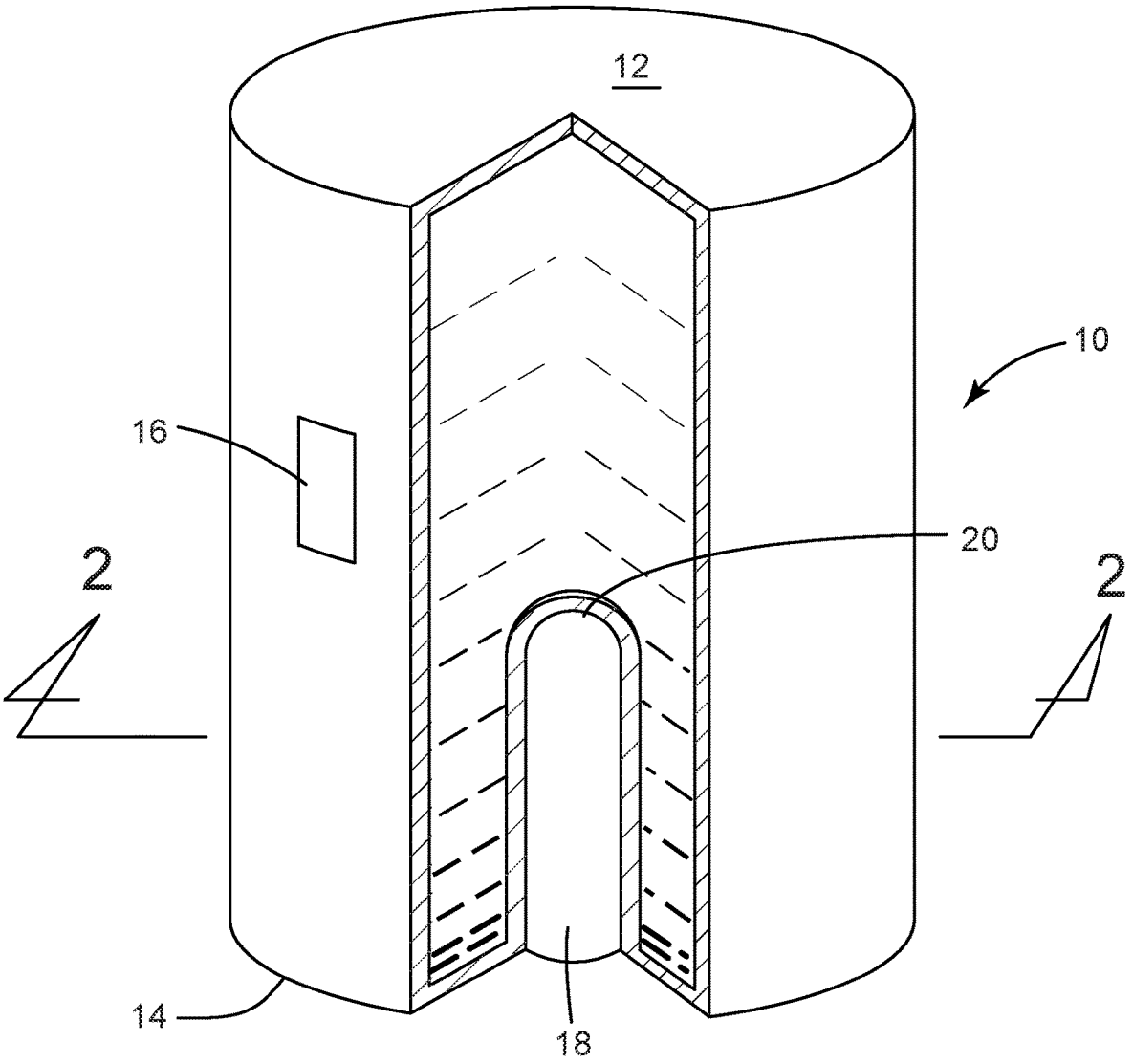
FIG. 1 is a partially broken away perspective view of a beverage container of the present invention according to a $1^{st}$ embodiment.
Figure 2:
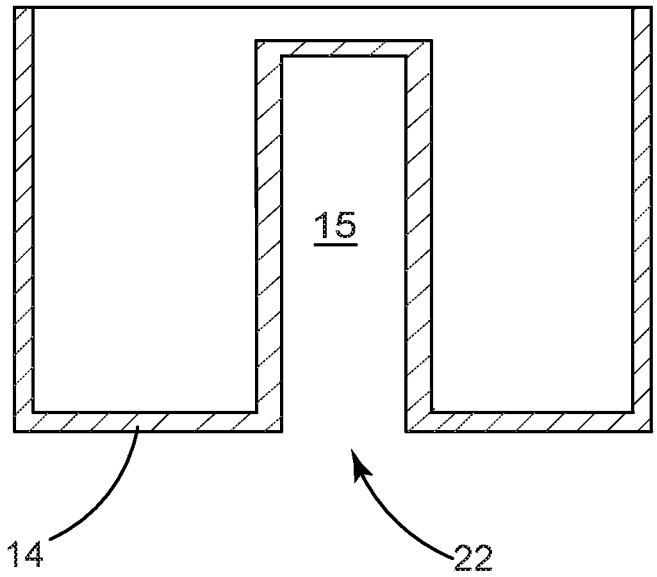
FIG. 2 is a sectional view taken along lines 2-2 of FIG. 1.
Figure 3:
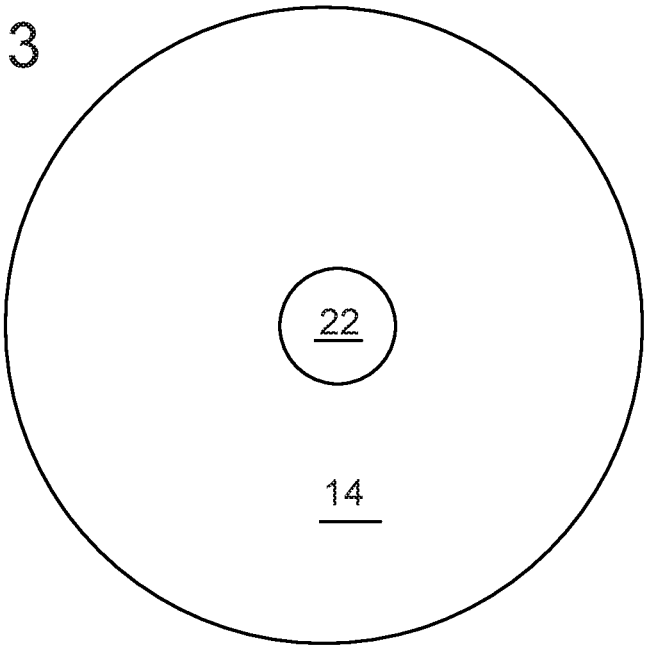
FIG. 3 is a bottom view of the beverage container of FIG. 1.
Figure 4:
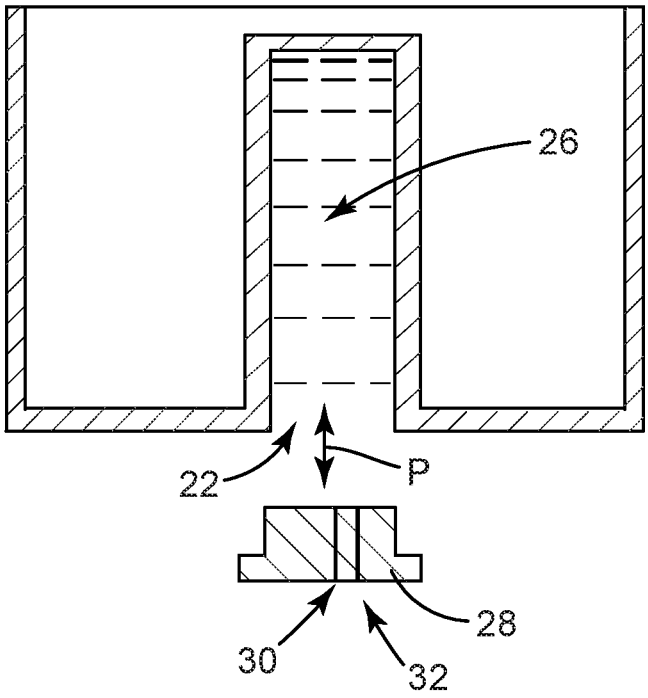
FIG. 4 is a sectional view of a sealing member for the bottom orifice of the beverage container.

FIGS. 1-4 illustrate a 1st embodiment in accordance with the present invention. A beverage container 10 is provided. The beverage container 10 includes a top 12 and bottom 14. An integral receptacle portion 15 is readily integrated into the bottom 14 of the container and provides an orifice 22 which is adapted to receive the non-toxic, inexpensive coolant 26, which can either be a single coolant such as ice or salt water or constitutes a combination of water and salt water with the water subjected to temperatures sufficient to freeze it to create ice and in which the ice has a freezing temperature above that of the beverage and the salt water is formulated to remain liquid below the freezing temperature of the ice and above the freezing temperature of the beverage.

In accordance with a preferred embodiment, coolant whether a single coolant or e.g. an ice and the salt water combination may be separately retained in bladders, with the bladders arranged so as to permit adjacent ice and salt water bladders to be brought into thermal contact, which in the process of reaching thermal equilibrium, will prolong the period of reduced temperature of the beverage subjected to the cooling effect of the coolant.

As is well recognized, two bodies brought into thermal contact will change their temperature seeking equilibrium, with the heat transferred from the higher temperature source to the lower temperature source.

Although the freezing temperature of water to ice is 32° F. (0° C.), if the environment surrounding the ice is lower than 32° F., the temperature of the ice will also be less than 32° F. As well, when a substance, for example ice is going through a phase change, from solid to liquid, the temperature of the ice and the temperature of the water will remain the same until the phase change is completed.

The present invention provides a beverage container with a receptacle 15 adapted to receive one coolant or two coolant components in thermal contact so that when the container is cooled below the freezing temperature of one of the coolant components, e.g. water, and above the freezing temperature of the other, e.g. salt water, the coolant serves to maintain the beverage 24 within the beverage container colder for an extended period of time.

Thus, for example, in a two coolant embodiment, a beverage container filled with beer will be pre-cooled in a refrigeration chamber to a temperature such that the water within the beverage container receptacle becomes ice and the salt water remains liquid. Once removed from refrigeration the coolant will continue to maintain the desirable reduced drinking temperature of the beverage for a longer period of time that if the coolant was not present.

Figure 7:
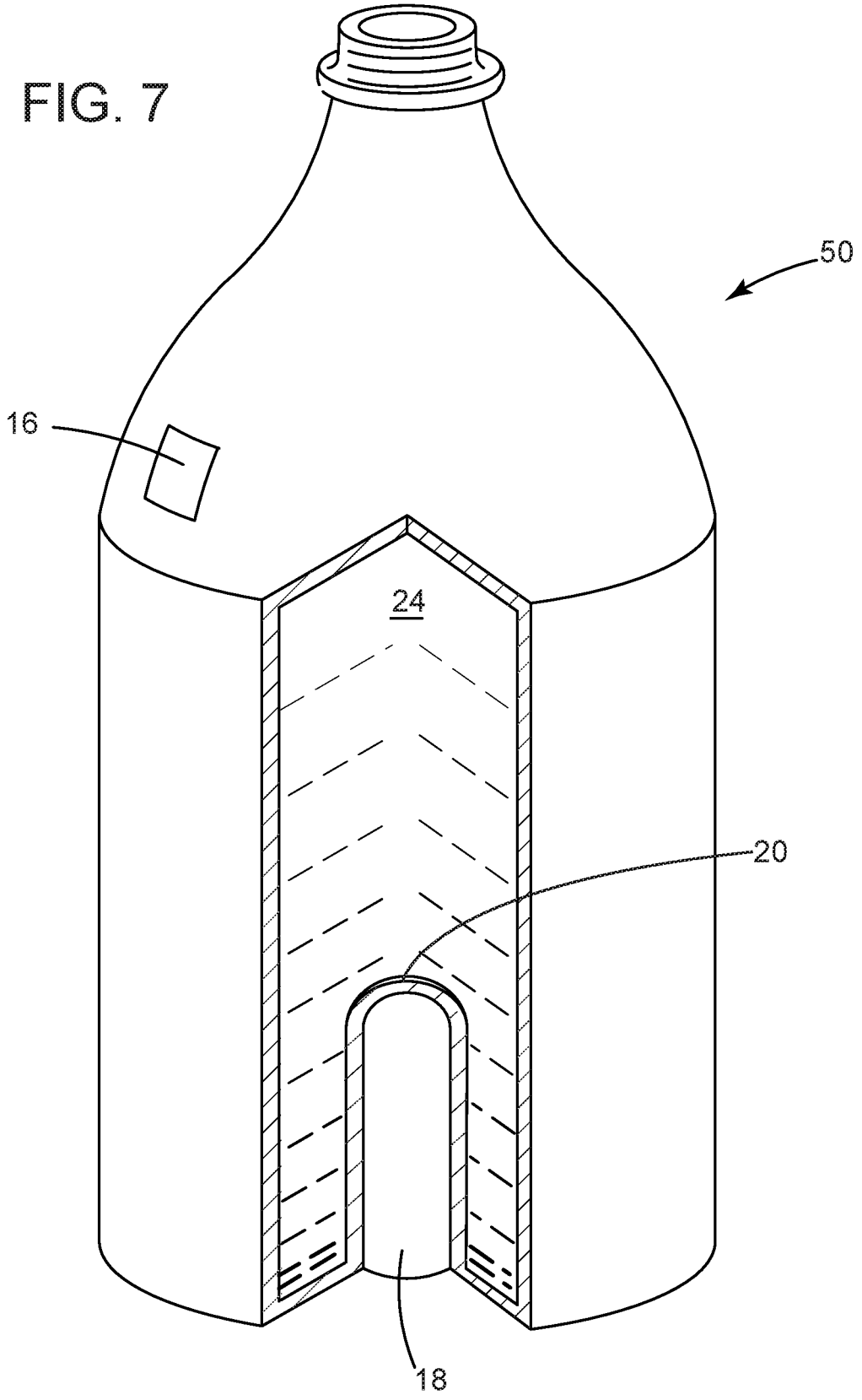
FIG. 7 is a partially broken away perspective view of an alternative beverage container (bottle) according to a $3^{rd}$ embodiment of the present invention.

Preferably, the beverage container 10 retains an outward appearance substantially similar to current containers such as the ubiquitous aluminum cylindrical beverage can (FIG. 1) or plastic or glass bottles (FIG. 7). Depending upon configuration, the containers may be slightly larger to accommodate the cooling chamber. Alternatively, the outside dimensions of the beverage container may remain unchanged with the amount of beverage reduced.

In one preferred embodiment, the cooling chamber is integrally formed with the container 10 as a hollow, preferably as a cylinder 18 having a domed top 20 and extending upward from the center of the bottom 14 of the container with the chamber extending at least partway into the container 10. Preferably, the base of the chamber is provided with a sealable orifice 22 adapted to seal the cooling chamber 15 after the coolant constituents are emplaced within the chamber.

In one embodiment, the coolants are separated by emplacing them within adjacent bladders to permit ready and efficient thermal contact. Although where at least two coolants are employed, it is contemplated each coolant constituents are retained in bladders, it is also contemplated that one or the other of the coolants can be contained in a bladder and the other filled into the cylinder in liquid form either prior to sealing of the chamber or after sealing by injection through a self-sealing fill hole 30. For example, the sealing of the bottom orifice 22 of the container can be by a plug 28 that permits liquid injection of the coolant 26 into the domed cylinder. Thus, for example, a bladder of water may be inserted into the cylinder 18; the bottom orifice 22 sealed with the plug 28 and the salt water injected subsequently, with the salt water freely circulating within the domed cylinder 18. The plug 28 may preferably include a vent 32 to evacuate air as the salt water is introduced. Alternatively, a bladder containing the salt water may be inserted into the chamber and the water injected through the self-sealing bottom plug 28.

Ice is preferred as either the singular coolant or as one of the coolants and is selected for its availability, cost and safety benefits. If a second coolant is used, salt water is preferred because its freezing temperature can be adjusted based upon its salinity and in any event has a freezing temperature below that at which water solidifies to ice.

Preferably the domed cylinder 18 is filled with the water and salt water constituents during the beverage filling processing. Both to compensate for the expansion of the water when it freezes, the combined liquid in the domed cylinder prior to the freezing of the water is less than the volume of the domed cylinder.

Figure 5:
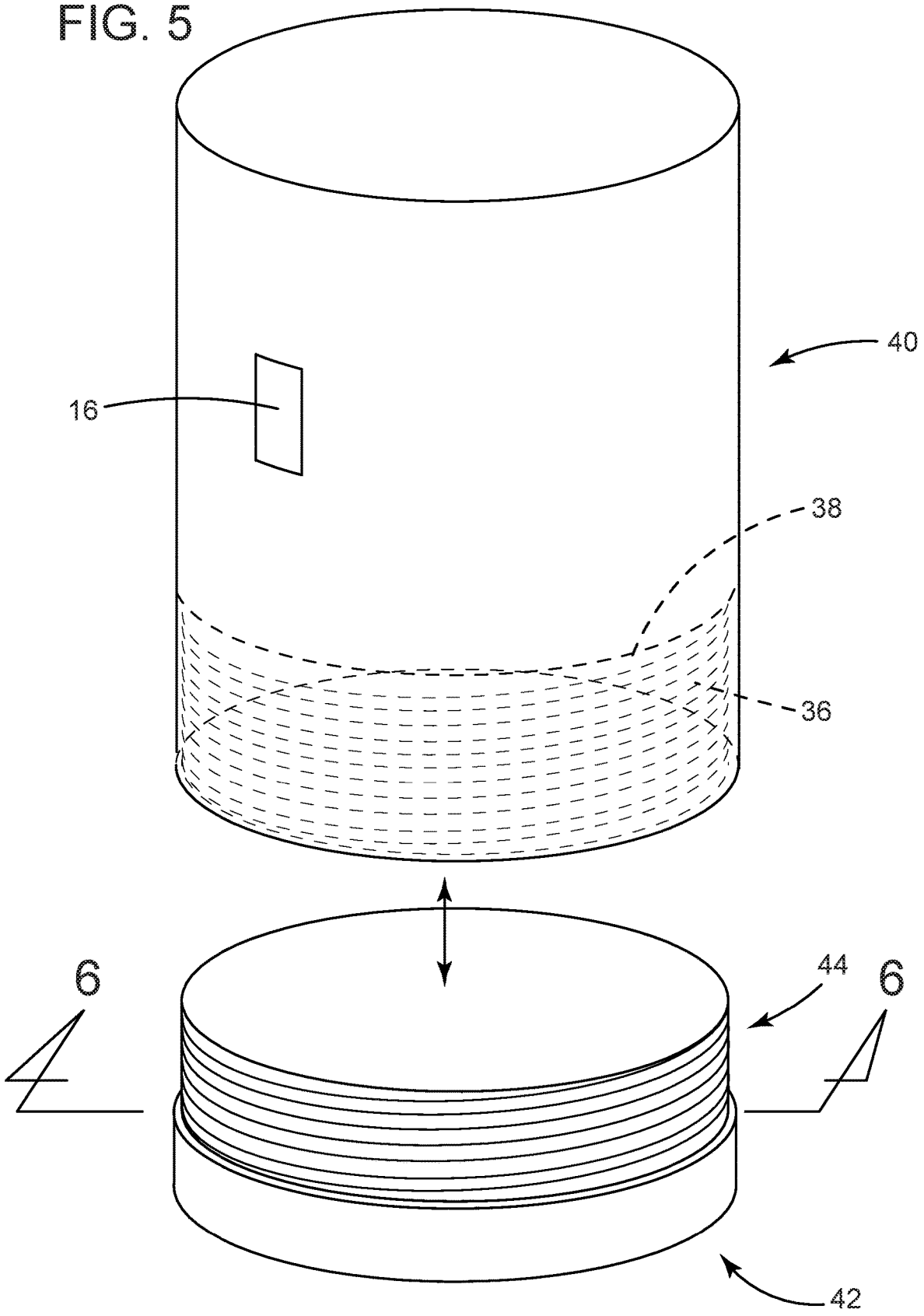
FIG. 5 is a view of an alternate beverage container in accordance with a $2^{nd}$ embodiment of the present invention.
Figure 6:
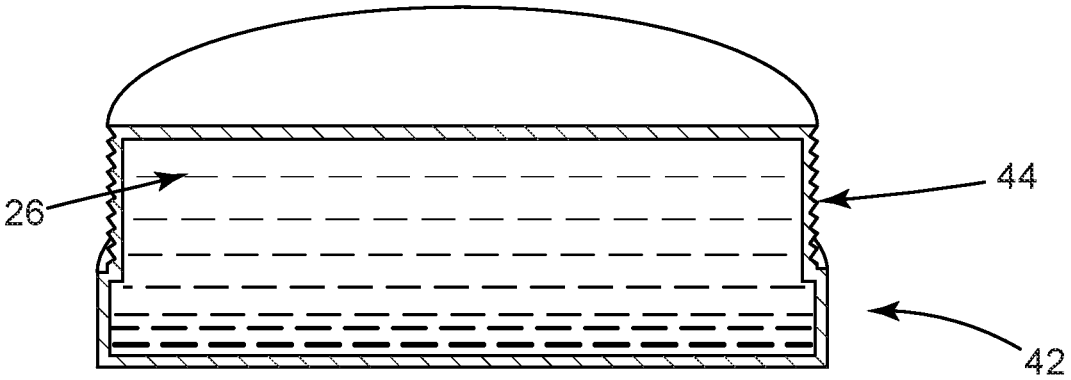
FIG. 6 is a sectional view taken along lines 6-6 of FIG. 5.

In accordance with a 2nd embodiment of the invention as illustrated by FIGS. 5-6, in lieu of an integral cylinder, the container may be provided with a removable bottom chamber 42. The bottom chamber 42 can be integral with or added to the container 40 after container formation. In one embodiment, the bottom 36 of the container 40 forms a hollow cavity beneath a planar surface 38, wherein the inner surface of the cavity is threaded in order to receive and secure a coolant filled or fillable bottom chamber 42 having corresponding threads 44. In this arrangement, the bottom chamber 42 contains a coolant 26 which cools the container 40 from beneath the beverage.

It is to be appreciated that the references to water and salt water as the constituents of the coolant is exemplary, albeit preferred. Depending upon the beverage another coolant can be employed—preferably one that if inadvertently released into the beverage or outside the beverage container is safe.

Once filled with a two coolant combination and the beverage, the container is subjected to a temperature below the freezing temperature of the water but above the freezing temperature of the salt water and the beverage. As will be appreciated, these temperature ranges are easily controlled by refrigeration devices that are universally available, and include the freezer compartment in home or commercial refrigeration which provide a ready ability to set temperature.

To avoid inadvertent exposure of the beverage container to an undesirably low temperature for an extended period, each container can include a visual temperature sensor/display 16 which indicates when a proper temperature of the beverage has been achieved.

Figure 8:
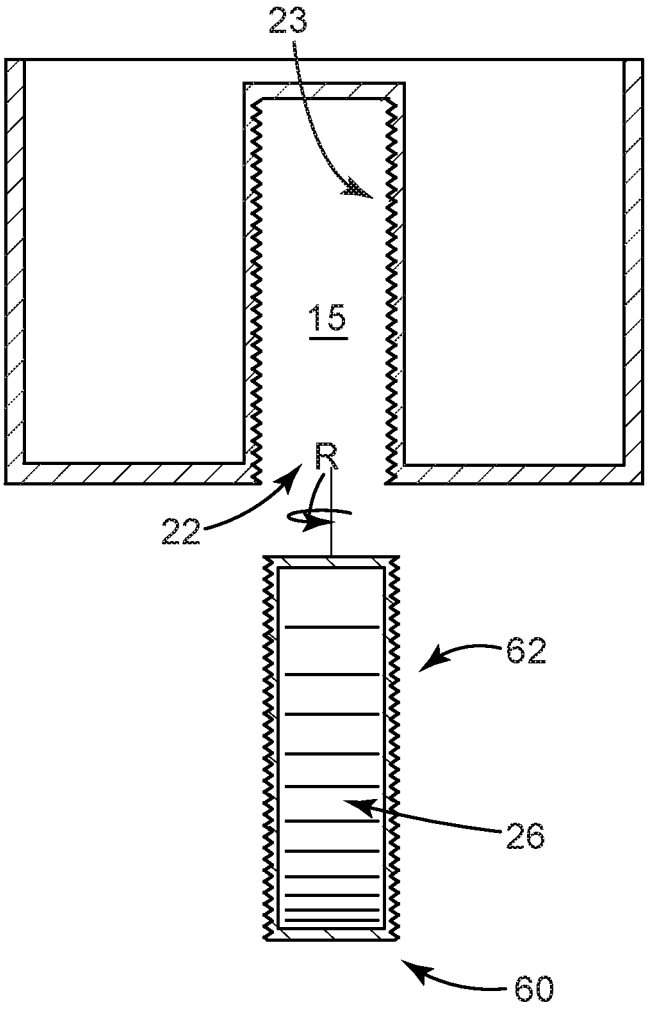
FIG. 8 is another partially broken away perspective view of yet another alternative beverage container in accordance with a $4^{th}$ embodiment of the present invention having an insertable coolant receptacle.

In accordance with a $4^{th}$ embodiment of the invention, as illustrated in FIG. 8, the coolant 26 can be contained within a detachable chamber 60 having threads 62 disposed on the outer surface for engaging with corresponding threads 23 positioned along the inner surface of the receptacle 15 above the orifice 22. The chamber 60 can be threadably engaged with the receptacle 15 by twisting in rotational direction R.

In another embodiment, the container is just a standard sized can (e.g. a 16 oz can) with a cavity in the bottom. The cavity is easily be stamped from the same aluminum blank used to make the can. An example would create a 16 oz device including a 4 oz cavity or chamber, and 12 oz of the desired beverage (which is the expected volume of as a standard 12 oz can). The chamber in this embodiment when filled contains only pure water. When the can is refrigerated to 29 deg-31 deg F., the beverage remains liquid and the pure water converts to ice and acts as the coolant. The ice in solid form when removed from refrigeration has a freezing point higher than the freezing point of the beverage (generally in this example 3-4 degrees F. higher), so the coolant is always solid and the beverage is always liquid when removed from refrigeration.

Figure 9:
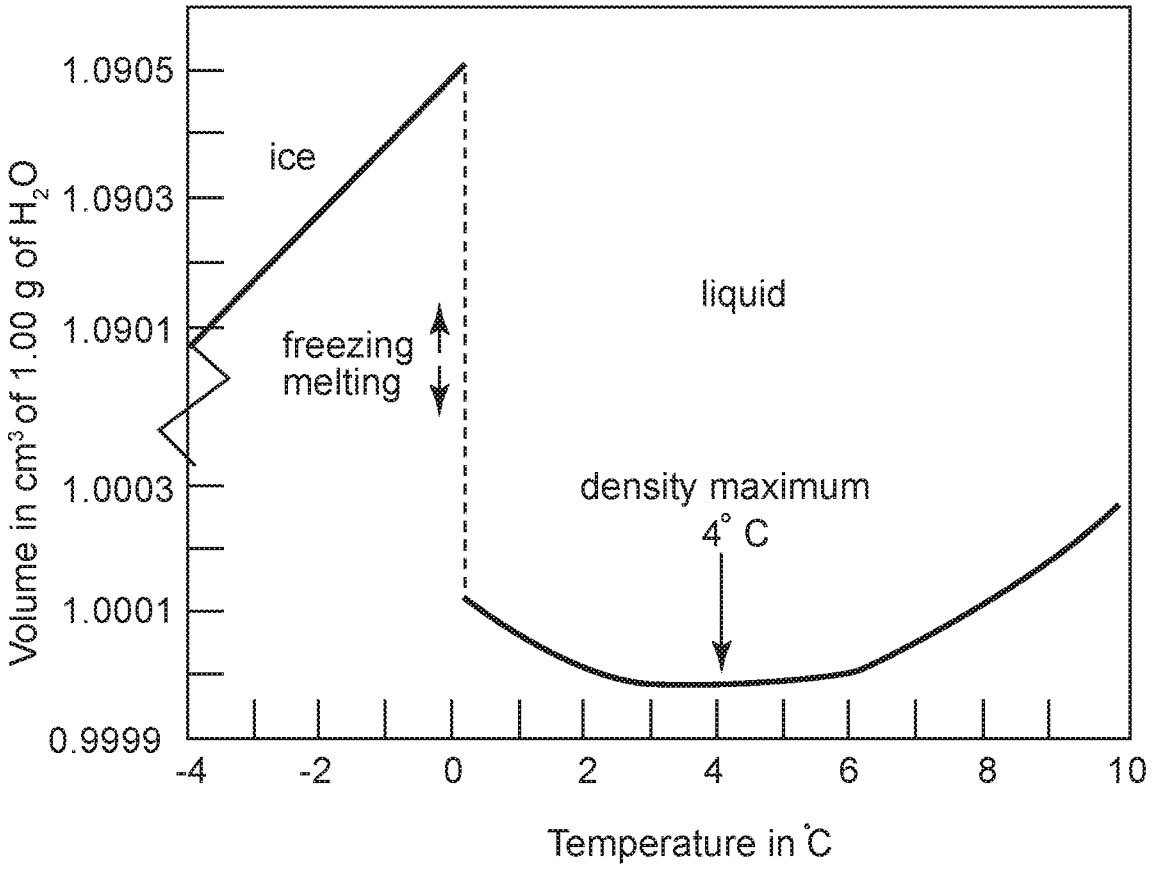
FIG. 9 illustrates a table of volume vs. temperature for $H_2O$.

With regard to the shape of the receptacle 15, it should be understood that the attached figures are only exemplary and are not drawn to scale. The shape of the receptacle can be adjusted to one that is best for dissipating heat, and for allowing expansion of the coolant (pure water) as it freezes. Since water is its most dense at or 39.2 deg F., the water contained in the chamber will expand as it is cooled below 39.2 deg F. and the shape of the chamber and amount of water in the chamber will have to be adjusted to accommodate for that expansion. FIG. 9 illustrates a table of volume vs. temperature for $H_2O$.

It is important to note the physics behind why the coolant should be water in its solid phase, rather than its liquid phase. This is because it requires 79.77 times more energy to change solid water (ice) into liquid water than it does to raise the temperature of liquid water (same volume) by 1 deg C. (which is the same as a 1 deg K temperature change).

It requires 334 kJ/kg to change solid water (ice) into liquid water (also called latent heat of melting), whereas it only requires 4.187 kJ/kgK to increase the temperature by 1 deg C. (also called specific heat of water) of the same volume of $H_2O$. See:

http://www.engineeringtoolbox.com/water-thermal-properties-d_162.html

Latent heat of melting—334 kJ/kg
Specific heat water—4.187 kJ/kgK
K=Kelvin
C=Celsius
F=Fahrenheit

Example 1

The following experiment was conducted on Mar. 5, 2017 by the inventor.

Container #1 was a standard 16 oz. plastic cup filled with about 12 oz. of BUDWEISER® beer.

Container #2 was a standard 16 oz. plastic cup filled with about 12 oz. of BUDWEISER® beer and with 6 equally sized plastic balls housing frozen distilled water of about 4 oz. total being submerged in the beer.

Container #3 was a standard 16 oz. plastic cup filled with about 12 oz. of BUDWEISER® beer and with a tin container housing frozen distilled water of about 4 oz. total being submerged in the beer.

All 3 containers were placed next to each other on a table, inside a room having a temperature of 71 deg F.

Table 1 below shows the temperatures of the beer, recorded from each container over time, taken with a RUBERMAID® dial thermometer model number THP220C.

TABLE 1

| Time | Container #1 (deg F.) | Container #2 (deg F.) | Container #3 (deg F.) |
|---|---|---|---|
| 12:48pm | 30 | 30 | 30 |
| 1:04pm | 34 | 32.5 | 34 |
| 1:14pm | 41 | 37 | 38 |
| 1:24pm | 49 | 37 | 38 |
| 1:34pm | 54 | 37 | 38 |
| 1:44pm | 58 | 37 | 38 |
| 1:54pm | 59.5 | 37 | 38 |
| 2:04pm | 60.5 | 38 | 38 |
| 2:14pm | 63 | 40 | 40.5 |
| 2:24pm | 65 | 40 | 42 |
| 2:28pm | 67 | 41 | 42 |
| 2:34pm | 67 | 41 | 42 |
| 2:44pm | 68 | 43 | 44 |
| 2:54pm | 68 | 45 | 46 |

Note: 5 ounces of beer was removed from each cup at 1:16 pm to simulate drinking.

Notice that 90 minutes after sitting at room temp (at 2:28 pm), container #1 (without any cooling medium) was almost at room temp (67 deg F.), while containers #2 and #3 were still close to out of a standard fridge temperature (41 & 42 deg F. respectively).

Additional Embodiments

In accordance with a $5^{th}$ embodiment of the invention as illustrated by FIGS. 10-15, the container may be provided with a coolant containing capsule. FIG. 10 illustrates a beverage container 71 having a removable tab closure 72. The beverage container 71 includes therein a coolant containing capsule 73. It is preferable that the capsule 73 be placed within the container 71 during the manufacturing of the container 71 or during filling of the container 71. In the latter case, the capsule 73 will be collapsible so as to permit egress and fillable after emplacement inside the container 71.

The coolant capsule 73 has within it a non-toxic inexpensive coolant which can be either a single coolant such as ice or salt water or constitutes a combination of water and salt water within separate compartments (not shown) so that when subjected to sufficient low temperatures the water will freeze, the salt water will remain in liquid form, and the beverage will remain in liquid form. A further description of this combination and how it is achieved is more fully described above.

As illustrated in FIG. 11, once the tab 72 is removed there is an opening 74 to permit the contents of the beverage to be dispensed. At various orientations of the beverage can, such as, for example, shown in FIG. 12, the coolant capsule 73 may come into relative juxtaposition to the opening 74. However, the diameter of the coolant capsule 73, which is in FIGS. 10 and 11 illustrated as spherical and larger than the opening 74 does not permit the capsule 73 to pass through the opening 74. The curvature of this sphere is selected such that it does not completely block the opening 74. Although, there is some restriction of beverage flow, the beverage is able to exit the container after passing over the cold surfaces of the capsule 74, thus enhancing cooling and permitting emptying of the beverage from the container 71.

Figure 13:
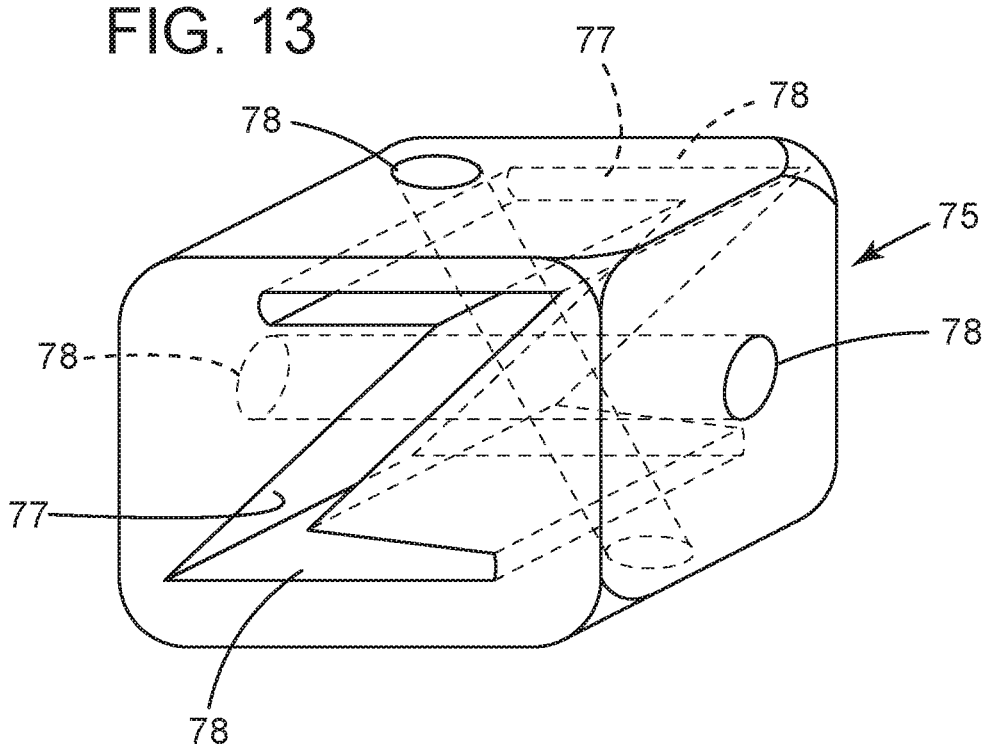
FIG. 13 is a perspective view of an alternate coolant capsule.
Figure 14:
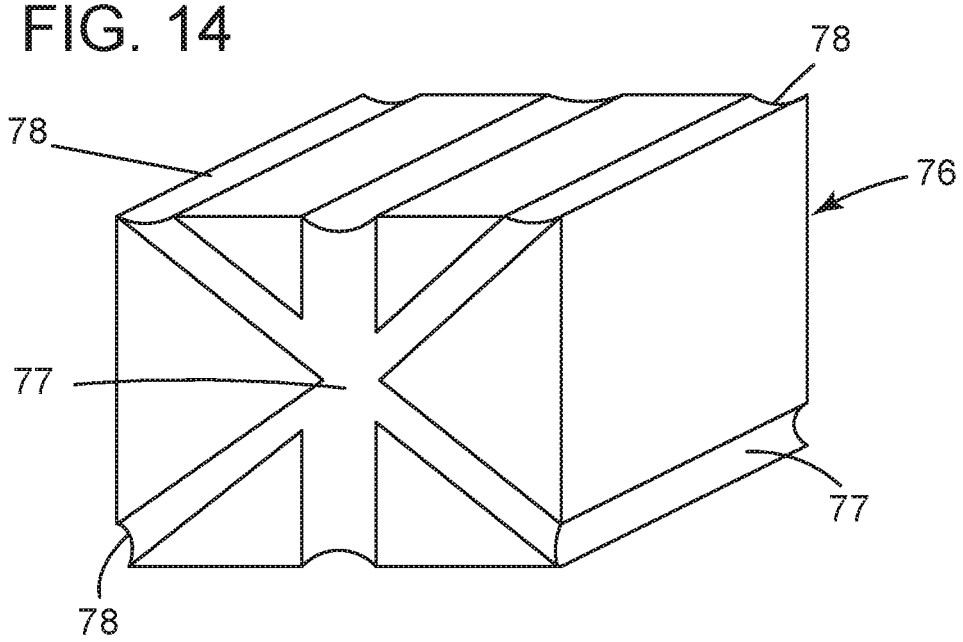
FIG. 14 is an alternative coolant capsule.
Figure 15:
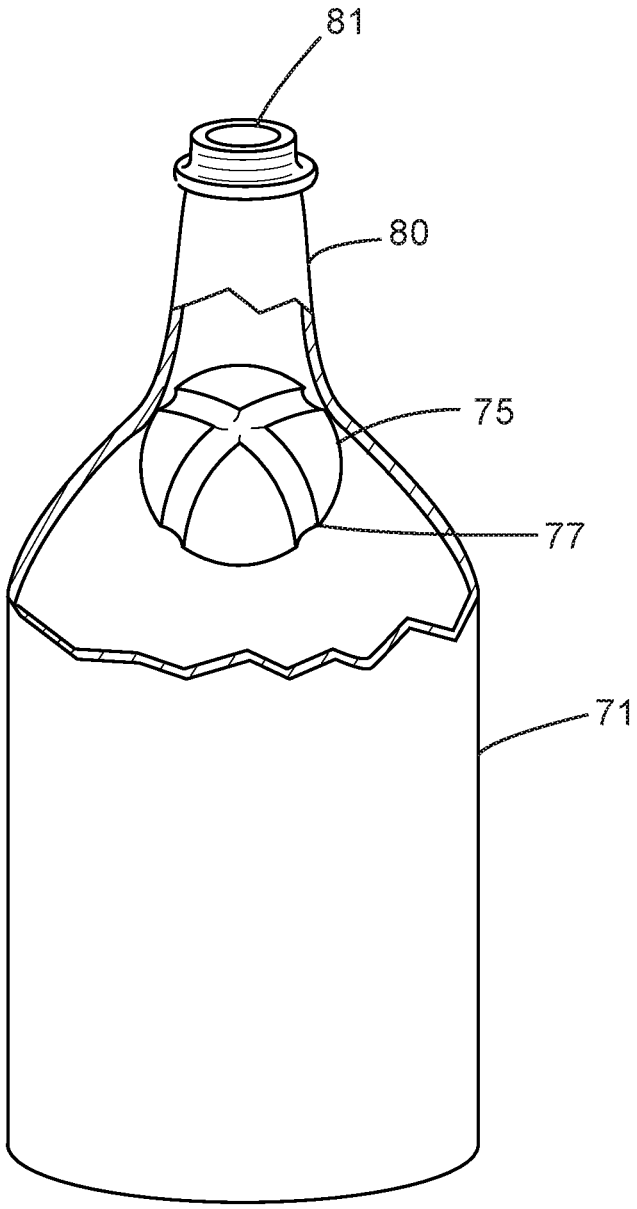
FIG. 15 is a perspective view, partially broken away of a bottle having emplaced therein the coolant capsule.

As illustrated in FIGS. 13 and 14, coolant capsules 75 and 76 respectively can be provided in which flow channels 77 are provided, with channel orifices 78 on all surfaces of the capsule such that liquid can flow through the capsule via the channels 77 even if the main body of the capsule is positioned between the container contents and the opening 74. In one embodiment, the flow channels can be arranged as grooves running along the outer surface of the capsule, not passing through the central body portion of the capsule. This is further illustrated in FIG. 15 in which a bottle 71 having a neck portion 80 has capsule 75 juxtaposed near the neck portion of the bottle positioned so that it would otherwise unduly restrict liquid flow from the bottle to the opening 81 but for the channels/grooves.

Although the embodiments illustrated in FIGS. 10-15 show a single capsule, multiple capsules may be employed.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

The invention claimed is:

1. A device for holding and cooling a beverage comprising a beverage container having an opening that permits the emptying of the beverage from the container, a coolant capsule within said container, said cooling capsule containing a cooling medium able to retain a cooling environment to cool the beverage and wherein said beverage container has a removable opening providing an orifice to permit beverage to be emptied and said capsule is dimensioned such that said capsule is larger than the opening but has surface characteristics which permit the beverage within the container to bypass the capsule and permit the liquid contents of the beverage container to exit the opening, wherein the capsule includes at least one internal channel which conveys the liquid content of the beverage through the capsule, from one side of the capsule to another side of the capsule.

2. The device according to claim 1, wherein said capsule includes multiple passageways to permit passage of therethrough providing passageway for liquid through said capsule on all major surfaces of said capsule.

3. The device according to claim 1 wherein the coolant medium includes a first coolant and a second coolant wherein the first coolant has a lower specific heat than the second coolant.

* * * * *